US005078165A

United States Patent [19]

Wu

[11] Patent Number: 5,078,165

[45] Date of Patent: Jan. 7, 1992

[54] AUTOMATIC UMBRELLA OPENED AND CLOSED BY A STRAIGHTFORWARD PUSH BUTTON

[75] Inventor: Tsun-Zong Wu, Taipei Hsien, Taiwan

[73] Assignee: Fu Tai Umbrella Works, Ltd., Taipei Hsien, Taiwan

[21] Appl. No.: 656,214

[22] Filed: Feb. 15, 1991

[51] Int. Cl.[5] ..... A45B 25/14

[52] U.S. Cl. ..... 135/24; 135/25.1

[58] Field of Search ..... 135/22–25.1

[56] References Cited

U.S. PATENT DOCUMENTS

| | | | |
|---|---|---|---|
| 4,534,374 | 8/1985 | Day | 135/22 |
| 4,682,617 | 7/1987 | Schultes et al. | 135/22 X |
| 4,825,888 | 5/1989 | Su | 135/24 X |
| 4,860,776 | 8/1989 | McQuain | 135/24 X |
| 4,928,718 | 5/1990 | Apple | 135/22 |
| 4,936,332 | 6/1990 | Wu | 135/24 X |
| 4,941,494 | 7/1990 | Wu | 135/22 X |
| 4,986,294 | 1/1991 | Wu | 135/22 |
| 4,989,625 | 2/1991 | Wu | 135/22 |

FOREIGN PATENT DOCUMENTS

| | | | |
|---|---|---|---|
| 2852998 | 6/1980 | Fed. Rep. of Germany | 135/24 |
| 0737046 | 9/1955 | United Kingdom | 135/22 |
| 2113991 | 8/1983 | United Kingdom | 135/24 |

*Primary Examiner*—David A. Scherbel
*Assistant Examiner*—Lan Mai

[57] ABSTRACT

An automatic umbrella includes: a central shaft having an upper shaft telescopically mounted on a lower shaft secured in a grip, a rib assembly pivotally secured to the central shaft, an extending spring for extending the ribs and opening the umbrella, a retraction restoring spring for closing the umbrella, and a straightforward push button resiliently retained in said grip which may be straightforwardly depressed to actuate an opening controller for opening the umbrella conveniently, and may also be further depressed straightforwardly to actuate a closing controller for easily closing the umbrella, without the need for selectively depressing a specific location on a push button.

6 Claims, 9 Drawing Sheets

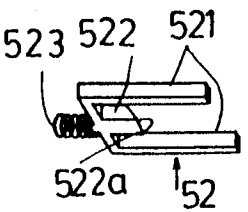
FIG. 5
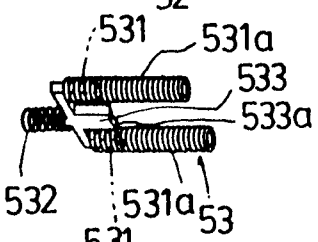
FIG. 6
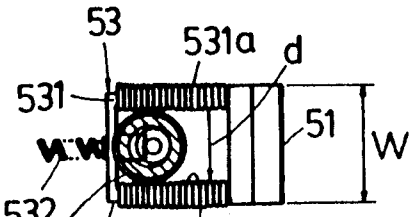
FIG. 9
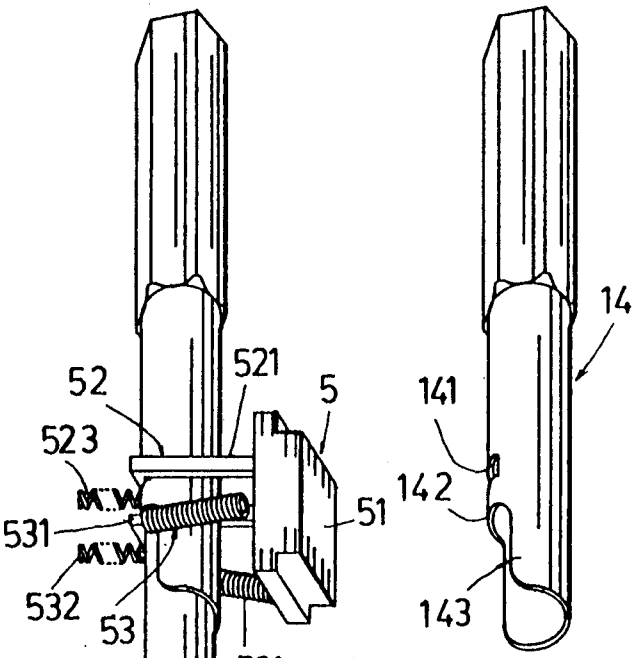
FIG. 7
FIG. 4
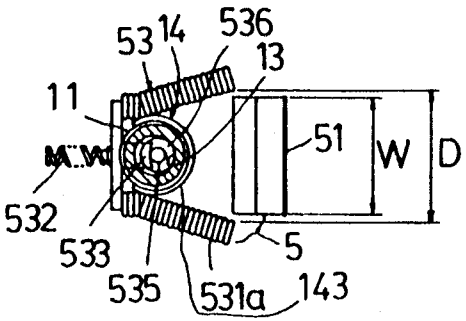
FIG. 8

AUTOMATIC UMBRELLA OPENED AND CLOSED BY A STRAIGHTFORWARD PUSH BUTTON

BACKGROUND OF THE INVENTION

U.S. Pat. No. 4,941,494 invented by the same inventor of this application entitled "Lightly-operating Automatic Umbrella for Preventing False Operation" discloses a seesaw button 51 for operatively depressing an extension controller 52 for opening the umbrella or operatively depressing a retraction controller 53 for closing the umbrella. By seesawly operating the push button 51 of the control means 5, the umbrella may be conveniently opened or closed. However, it should be careful to watch the position of an upper lever 511 of the button 51 in order to actuate the extension controller 52 for opening the umbrella or to watch the location of a lower lever 512 for actuating the retraction controller 53, thereby still causing operating inconvenience for opening or closing the umbrella. It is more inconvenient in a dark weather or at night for depressing such a lever 511 or 512.

The present inventor has found the drawbacks of such a patent earlier invented by the present inventor, and invented the present automatic umbrella which can be opened or closed by straightforwardly depressing a push button of the umbrella.

SUMMARY OF THE INVENTION

The object of the present invention is to provide an automatic umbrella having a straightforward push button resiliently held in a grip of the umbrella, an opening controller normally locking a shaft of the umbrella at a folded state and operatively actuated by depressing the push button for opening the umbrella, and a closing controller normally retarding a closing movement of an opened umbrella and operatively actuated by depressing the push button for closing the umbrella, in that the operation for opening or closing the umbrella is effected by merely depressing the push button straightforwardly, other than a selective depression on an upper portion or a lower portion of the button, for a convenient opening or closing operation of the umbrella.

BRIEF DESCRIPTION OF THE DRAWINGS

FIG. 4 is an illustration showing a control means and an upper shaft of the present invention.

FIG. 5 shows an opening controller of the control means of the present invention.

FIG. 6 shows a closing controller of the present invention.

FIG. 7 shows an upper shaft of the present invention.

FIG. 8 is a cross sectional view of the closing controller of the present invention.

FIG. 9 shows the closing controller normally contacting a push button of the present invention.

DETAILED DESCRIPTION

Figure 1:
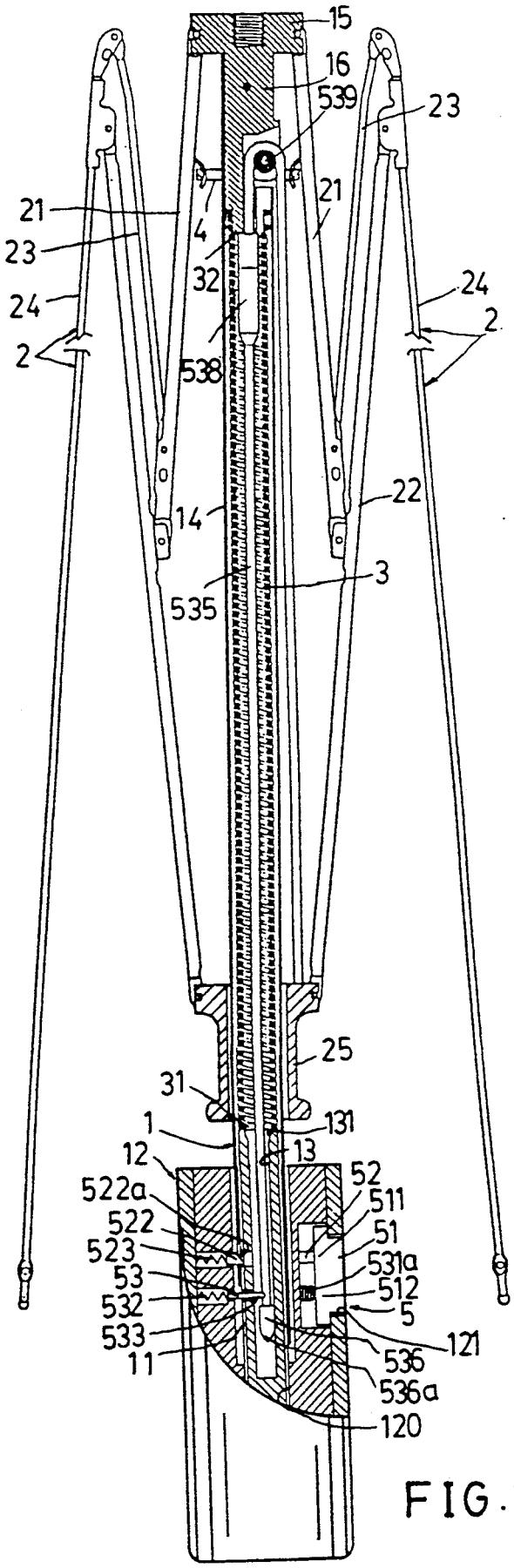
FIG. 1 is an illustration of the present invention when folded.

As shown in FIGS. 1–13, the present invention comprises: a central shaft means 1, a rib assembly 2 for securing an umbrella cloth thereon, an extending spring 3 for opening the umbrella, at least a retraction restoring spring 4 for closing the umbrella, and a control means 5 for the control of opening or closing operation of the umbrella.

The central shaft means 1 includes: a lower tubular shaft 11, a grip 12, a sleeve 13 fixed in the lower shaft 11, an upper tubular shaft 14 telescopically mounted on the lower shaft 11, and an upper notch 15 formed on a top portion of the upper shaft 14 having an inner block 16 fixed therein.

The lower tubular shaft 11 has its lower portion inserted in a central shaft hole 120 in the grip 12. The sleeve 13 includes an upper taper opening 131 for smoothly guiding a locking head 536 of the closing controller 53 of the control means 5 into the sleeve 13. The upper tubular shaft 14 is formed with a lower hole 141 in a lower portion of the shaft 14.

The rib assembly 2 is conventional as found in a conventional umbrella and may include: a first top rib 21 having an inner end portion of the rib 21 pivotally secured to the notch 15, a stretcher rib 22 having an inner end portion of the rib 22 pivotally secured to a runner 25 slidably encompassed on the upper tubular shaft 14 and having a middle portion of the rib 22 pivotally secured with an outermost end portion of the first rib 21, a second top rib 23 having its inner end portion pivotally secured to a second outer end portion of the first rib next to an outermost end portion of the first rib, and a third top rib 24 respectively pivotally secured to two outermost end portions of both second top rib 23 and stretcher rib 22.

The extending spring 3 is an elongate coil spring having a diameter of each spring ring generally equal to an inside diameter of the lower shaft 11 having its lower end 31 retained on a top end of the sleeve 13 and having its upper end 32 retained against a bottom portion of the inner block 16 secured to the upper notch 15.

Figure 2:
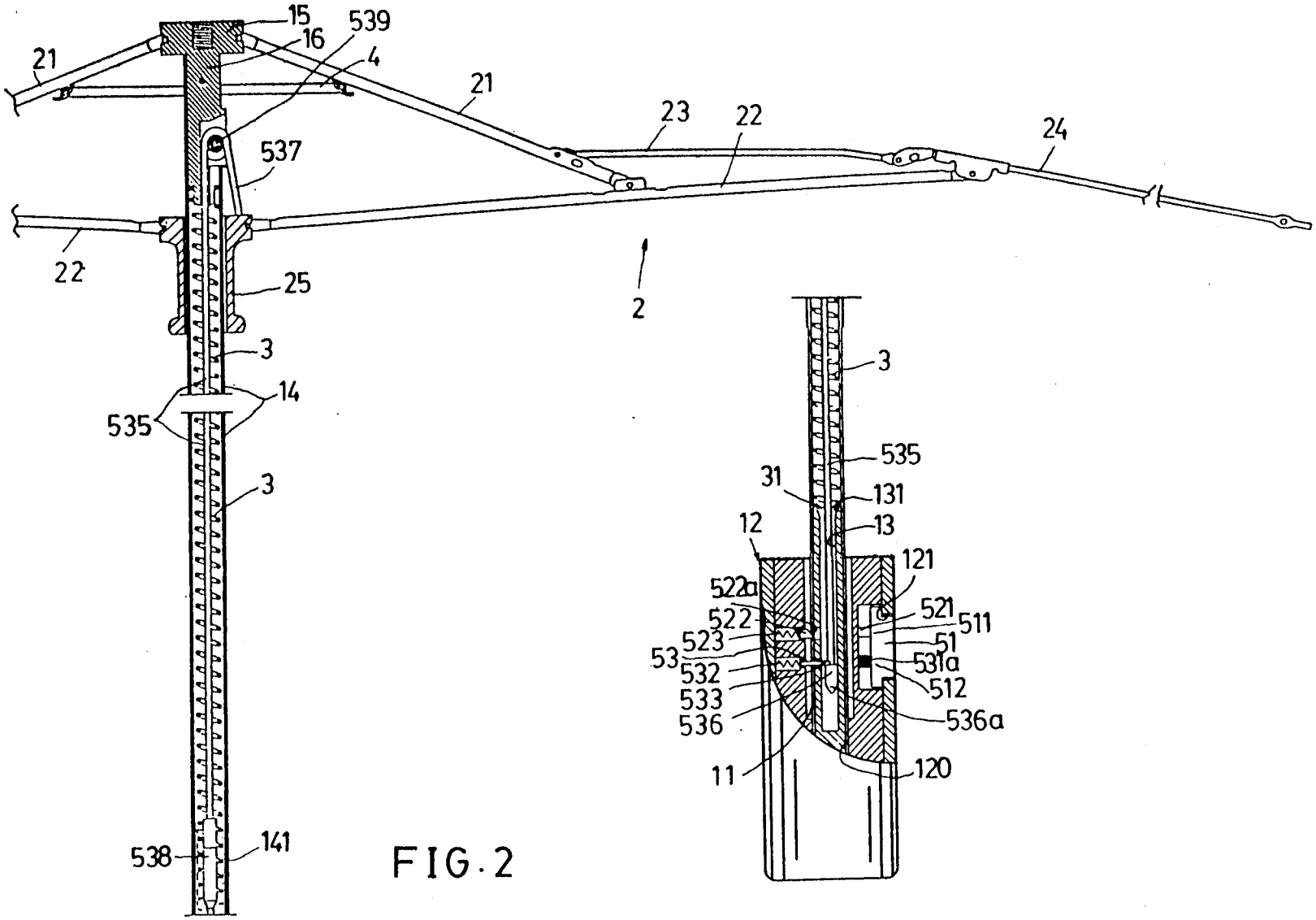
FIG. 2 is an illustration of the present invention when opened.
Figure 3:
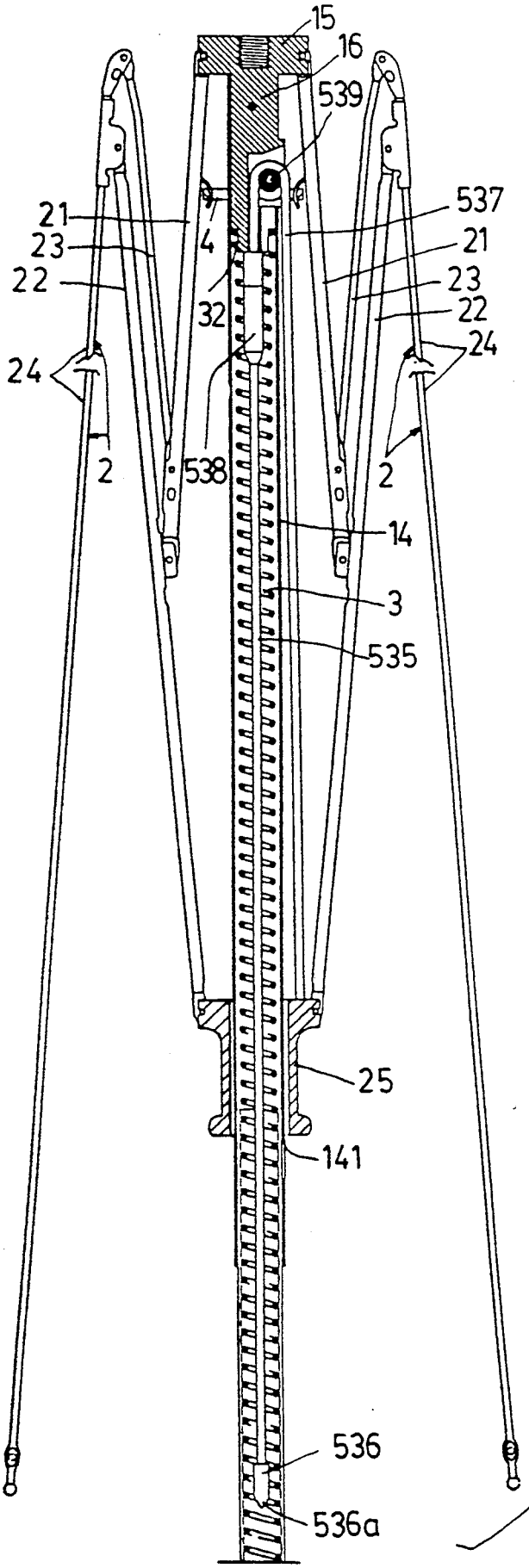
FIG. 3 shows the present invention when closed.
Figure 3:
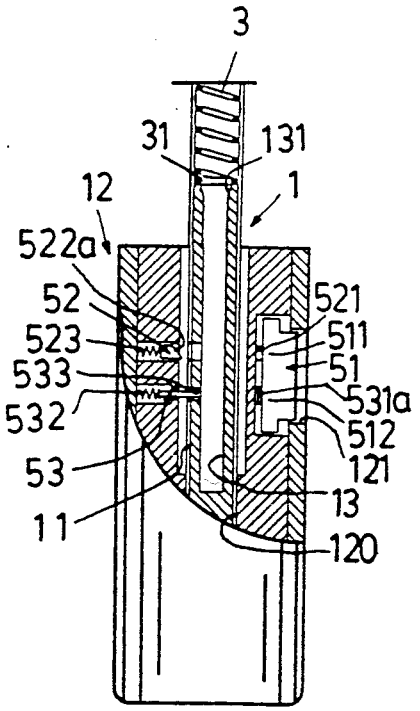

The retraction restoring spring 4 normally urges the rib assembly 2 towards a collapsed state, such as for normally urging the strether rib 22 and runner 25 downwardly as shown in FIG. 3 so as to close the umbrella. The elastic force of the spring 4, when compressed by extending the rib assembly 2 when opening the umbrella as shown in FIG. 2, should always be smaller than the elastic force of the extending spring means 3 under compression when the umbrella is closed and the tubular shafts are shortened to accumulate the elastic force of the spring 3 as shown in FIG. 1.

The control means 5 includes: a straightforward push button 51, an opening controller 52 for controlling the extension of upper shaft 14 and the opening of the umbrella, and a closing controller 53 for the control of the retraction of the rib assembly 2 and the closing of the umbrella.

The push button 51 is resiliently held in a button hole 121 formed in a side portion of the grip 12, having an upper portion 511 contacting the opening controller 52, a lower portion 512 operatively contacting the closing controller 53, and an inner base extension 513 resiliently retained in a side wall of the grip 12.

Figure 10:
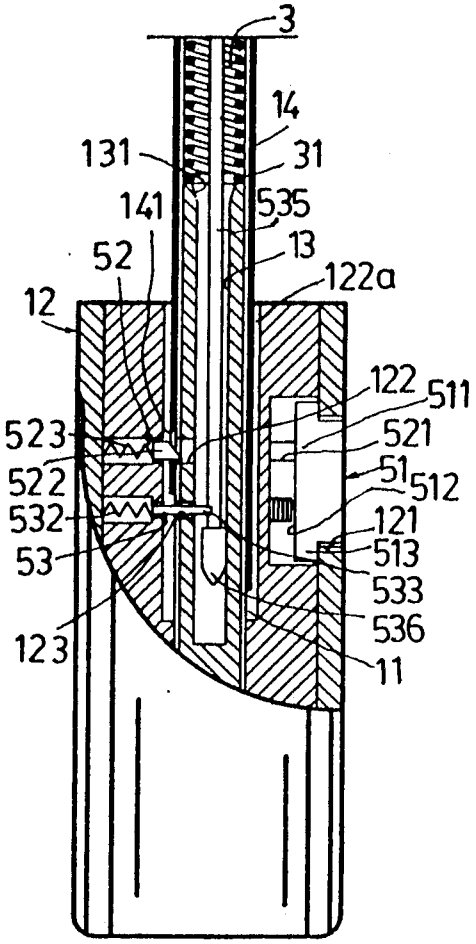
FIG. 10 shows a folded closed umbrella in accordance with the present invention.

The opening controller 52 includes: a pair of bifurcate arm members 521 laterally held in an upper slot 122 formed in an upper portion of the grip 12 slidably disposed around a lower portion of the upper shaft 14, a latch portion 522 formed in a central portion of the controller 52 between the two arm members 521 having an outer portion 522*a* tapered downwardly and having a length shorter than that of the arm member 521, and an upper tensioning spring 523 held in an upper portion of the grip 12 resiliently urging the latch portion 522 outwardly to engage the lower hole 141 of the upper shaft 14 when folding the umbrella as shown in FIG. 10 and resiliently urging the two arm members 521 outwardly to contact the upper portion 511 of the push button 51.

The closing controller 53 includes: a pair of bifurcate short stems 531 formed on two opposite sides of the controller 53 slidably disposed around said lower shaft 11 each stem 531 jacketed with a helical spring 531*a* thereon, a lower tensioning spring 532 formed in a lower portion of the grip 12 below the upper spring 523 normally urging the stems 531 and the helical springs 531*a* outwardly to contact the lower portion 512 of the push button 51, a retarding plate 533 formed on a central portion of the controller 53 between the two stems 531 having an arcuate surface 533*a* formed on an outer portion of the retarding plate 533, a drag rod 535 slidably held in the shaft means 1 having a lower locking head 536 secured to the rod 535 having a diameter of the head 536 larger than that of the rod 535 and a taper portion 536*a* formed on a lowest end portion of the head 536, and a flexible rope 537 (or wire) trailed inside the shaft means 1 or outside a tubular wall of the upper shaft 14 having an inner end portion of the rope 537 secured to a coupling 538, which connects the rod 535 and the rope 537, and an outer end portion of the rope 537 secured to the runner 25, and a roller 539 pivotally mounted on the inner block 16 for slidably guiding the rope 537 thereon.

The drag rod 535 has a length generally equal to a length of a shortened folded shaft means 1 as shown in FIG. 1 having its lower locking head 536 normally locked by the retarding plate 533 and having its upper end portion secured with the coupling 538 limited by the inner block 16 secured on the upper portion of the upper shaft 14.

The flexible rope 537 has a length generally equal to a length between the runner 25 when closing the umbrella and retracting the ribs 2 inwardly towards the shaft 1, and the inner block 16, against which block 16 the coupling 538 is retained as shown in FIG. 3. A total length of the length of the upper rope 537 plus the length of the lower rod 535 is generally equal to a length of an extended shaft means 1 as shown in FIG. 2.

Figure 11:
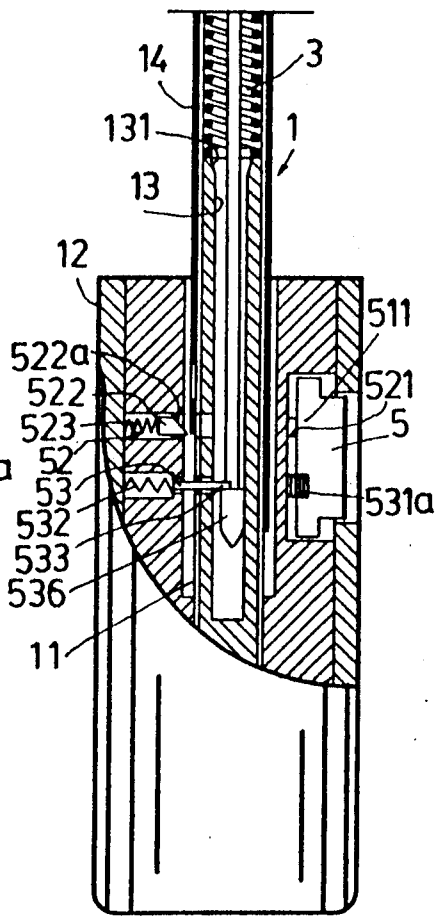
FIG. 11 shows a first step for opening the umbrella of the present invention.

When it is intended to open the folded umbrella as shown in FIGS. 1, 10, the straightforward push button 51 is straightforwardly depressed as shown in FIG. 11 to press the latch portion 522 inwardly to disengage the hole 141 of the upper shaft 14 and the extending spring 3 will urge the inner block 16 and the upper shaft 14 upwardly so as to extend the ribs 2 outwardly upwardly for opening the umbrella as shown in FIG. 2.

The rope 537 and rod 535 having the locking head 536 locked by the closing controller 53 are linearly linked to counteract a retraction force urged by the restoring spring 4 for preventing a closing of umbrella when extended as shown in FIG. 2.

Figure 12:
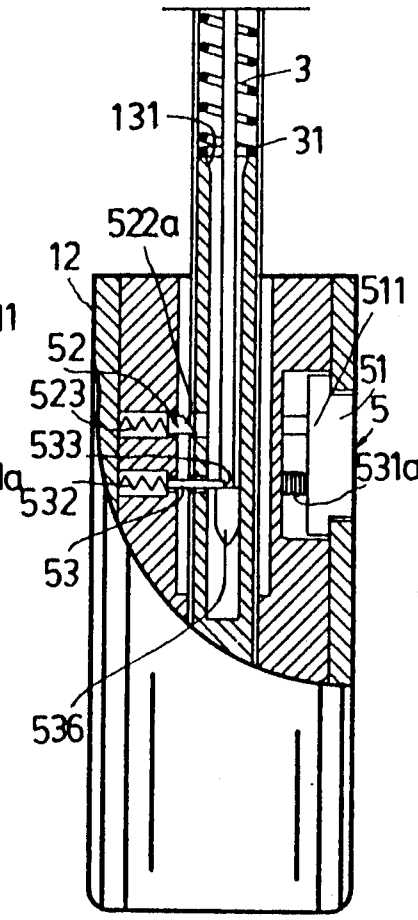
FIG. 12 shows a second step for opening the umbrella of the present invention.

As shown in FIG. 10, when the umbrella is at its folded state, a lower portion of the upper shaft 14 is formed with a recess portion 142 under the lower hole 141 and a lower flange 143 protruding downwardly from the recess portion 142 to be lower than the position of the bifurcate stems 531 and helical springs 531*a* of the closing controller 53 when folding the umbrella by engaging the latch portion 522 of the opening controller 52 with the lower hole 141 of the upper shaft 14. By the way, the lower flange 143 of the upper shaft 14 slidably held on the lower shaft 11 will bias the two helical springs 531*a* sidewardly as shown in FIG. 8 to form an aperture D between the two separated springs 531*a*, which aperture D is greater than a width W of the push button 51 so that during the depression of the push button 51 to open the umbrella as shown in FIG. 11 from FIG. 10, the inward movement of the button 51 will not depress the two springs 531*a* in view of FIG. 8, thereby without falsely actuating the closing controller 53 and thereby still locking the locking head 536 by the retarding plate 533 of the closing controller. FIG. 12 shows a fully opened umbrella grip 12 and controller 5.

Meanwhile, when the umbrella is folded and an umbrella cloth is fastened by a tie closure (not shown), a false depression of the push button 51 may depress the opening controller 52 (the bifurcate arm members 521) to disengage the latch portion 522 from the hole 141 of the upper shaft 14 to allow the extending spring 3 to "extend" the shaft 1, but retarded by the tie closure. At this time, if a false depression of the push button will not actuate the closing controller 53 since the lower flange 143 of the upper shaft 14 still biases to separate the two springs 531*a* of the closing controller 53, unable to be depressed by the button 51 to thereby prevent a false operation of the umbrella.

Figure 13:
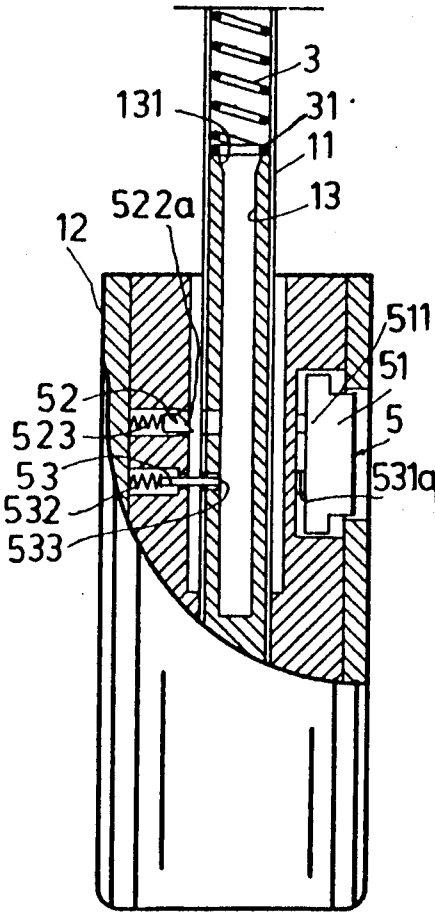
FIG. 13 shows a further step for closing the umbrella of the present invention.

For closing the umbrella, the button 51 is depressed from FIG. 12 to FIG. 13 to press the two helical springs 531*a* and the retarding plate 533 inwardly to release the locking head 536. Simultaneously, the restoring spring 4 normally urges the stretcher rib 22 and runner 25 downwardly to retract the rib assembly 2 towards the central shaft means 1 to pull the rope 537 outwardly through the roller 539 to raise the rod 535 upwardly until being limited by the block 16 since the rod 535 and locking head 536 is no longer locked by the retarding plate 533, thereby closing the umbrella automatically as shown in FIG. 3. At this time, the spring 3 is still at released situation so that a resetting or restoring operation must be done by depressing the grip 12 towards the upper notch 15 so as to shorten or fold the plural shafts and to restore the spring 3 for accumulating its resilience energy or elastic force for next opening or extension operation (FIG. 3 to FIG. 1).

After extending the shaft 14 to open the umbrella as shown in FIG. 12, the lower flange 143 of the upper shaft 14 is left from the lower shaft 11 and the two helical springs 531*a* will not be biased and will be linearly erected on the two short stems 531 as shown in FIG. 9 (perpendicular to the button 51) to define an aperture d smaller than a width W of the button 51, so that the depression of button 51 from FIG. 12 to FIG. 13 will exactly depress the springs 531*a* and the closing controller 53 for closing the umbrella as shown in FIG. 3.

When folding the umbrella from FIG. 3 to FIG. 1, the recess portion 142 of the upper shaft 14 will first meet the tapered outer portion 522*a* of the latch portion 522 to depress the latch portion 322 inwardly to poke the lower portion of the shaft 14 into a socket 122*a* of the grip 12 until engaging the latch portion 522 with the hole 141 of the shaft 14 to stably fold the umbrella. The recess portion 142 should be positioned above the retarding plate 533 of the closing controller 53 to prevent any obstruction of the operation of the controller 53.

Another preferred embodiment of the present invention is shown in FIGS. 14–20, which comprises a control means 5 modified from the aforementioned including a straightforward push button 51 having an upper bottom portion formed with a lever recess 511, an opening controller 52 formed as a biasing lever, and a closing controller 53 as same as aforesaid.

Figure 14:
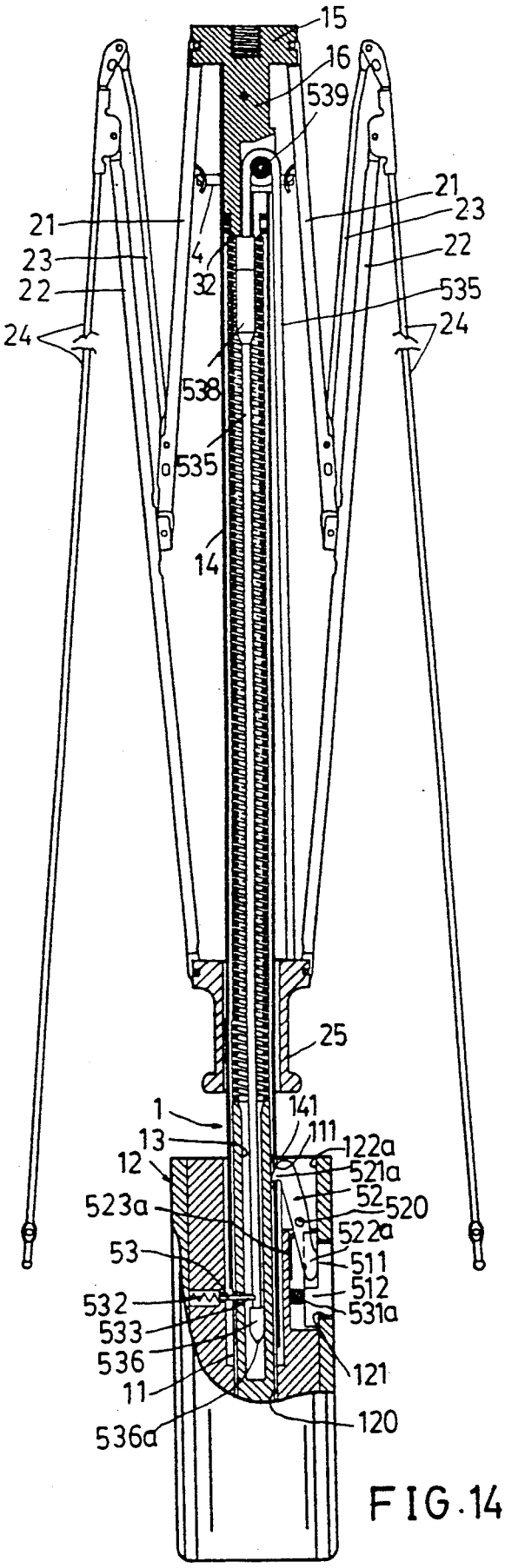
FIG. 14 shows another preferred embodiment of the present invention when folded.
Figure 17:
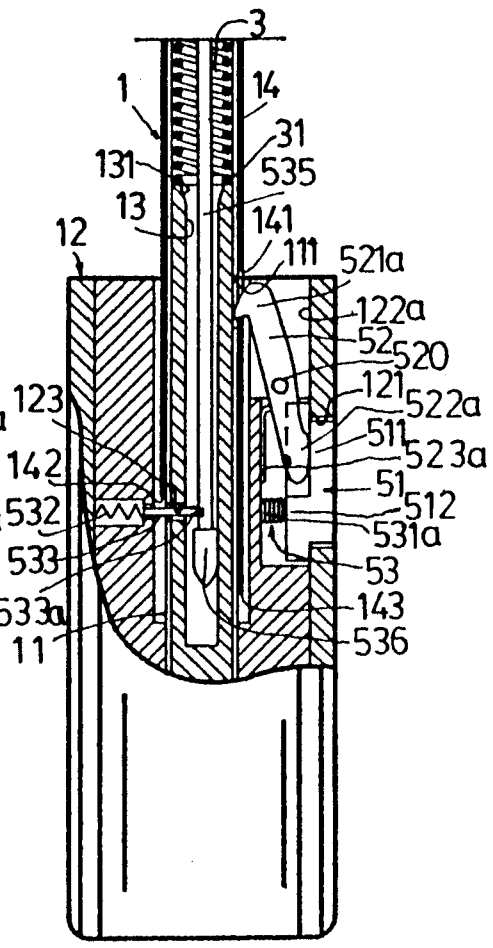
FIG. 17 shows a folded closed umbrella of the present invention as shown in FIG. 14.

The opening controller 52 formed as a biasing lever includes a pivot 520 for pivotally mounting the controller 52 in a socket 122*a* in the grip 12, a hook portion 521*a* formed on an upper portion of the controller 52 engageable with a lower hole 141 of the upper shaft 14 and a hook hole 111 formed in the lower shaft 11 for locking a folded umbrella as shown in FIG. 17 and FIG. 14, and a depression block 522*a* resiliently retained by an upper tensioning spring 523*a* secured in the grip 12 and operatively depressed by the button 51. The tensioning spring 523*a* normally urges the depression block 522*a* outwardly to be pressed by the button 51.

Figure 15:
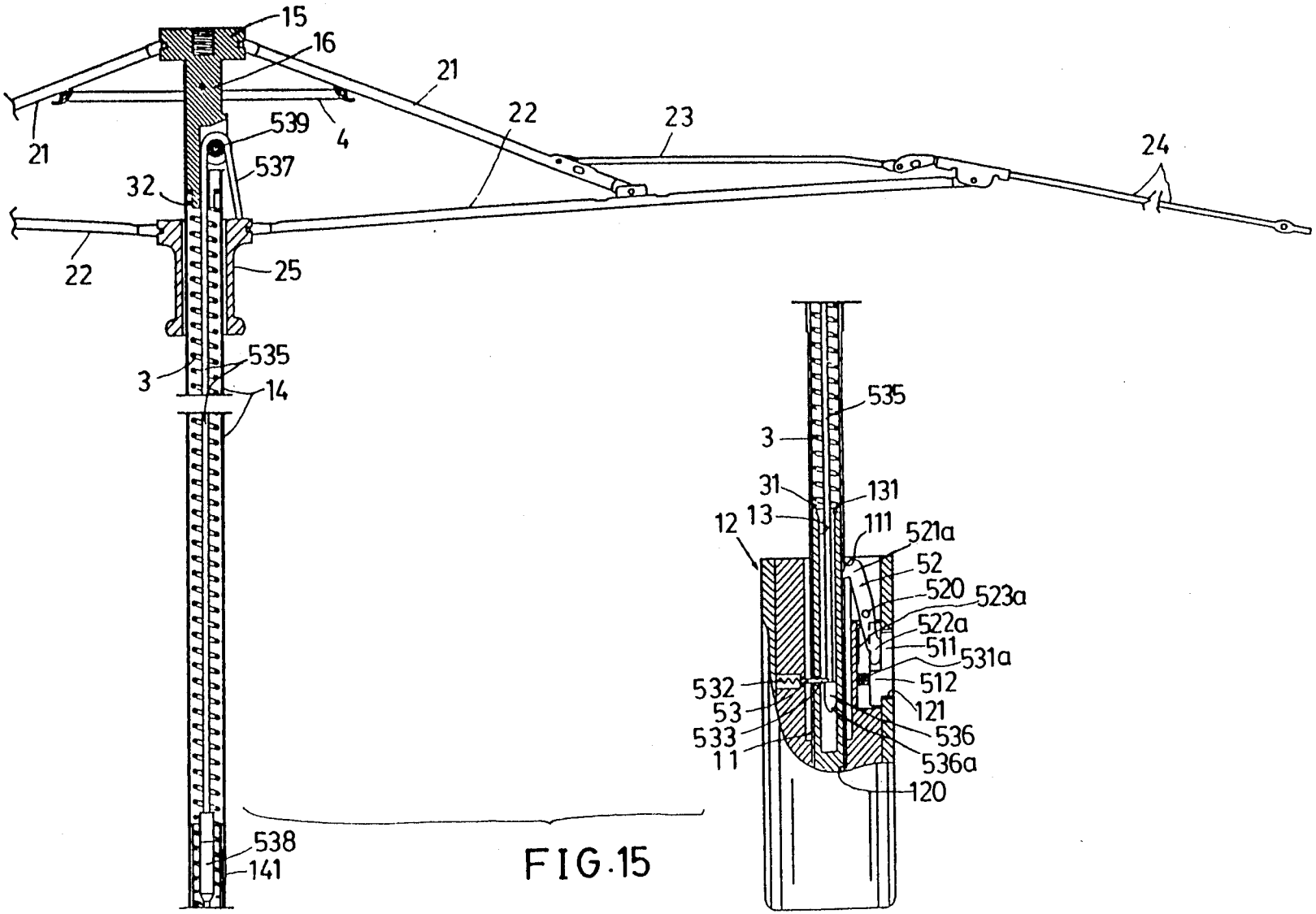
FIG. 15 shows an opened umbrella of the present invention as shown in FIG. 14.
Figure 18:
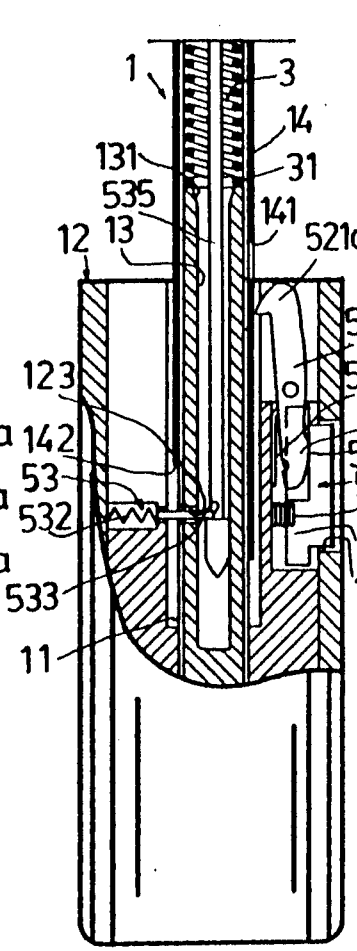
FIG. 18 shows a first step for opening the umbrella as shown in FIG. 14.
Figure 19:
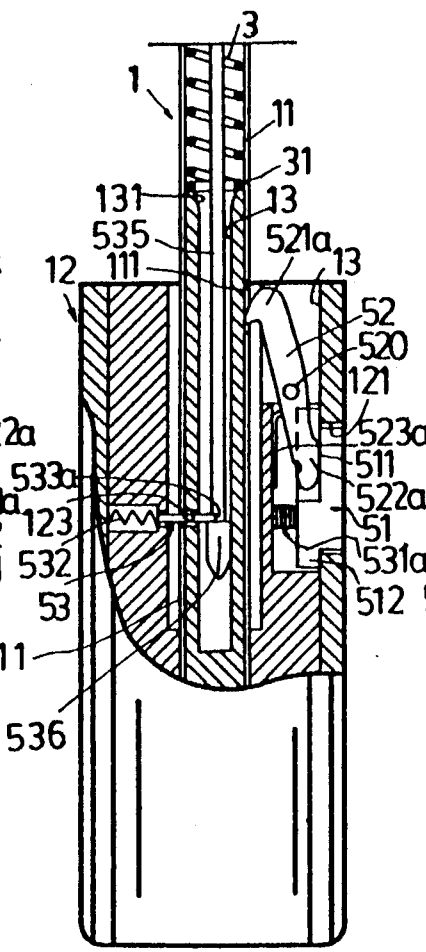
FIG. 19 shows a second step for opening the umbrella also shown in FIG. 15.

After depressing the button 51 as shown in FIG. 18, the upper shaft 14 is disengaged from the hook portion 521*a* as urged by the extending spring 3 to thereby open the umbrella as shown in FIG. 15 and FIG. 19.

Figure 16:
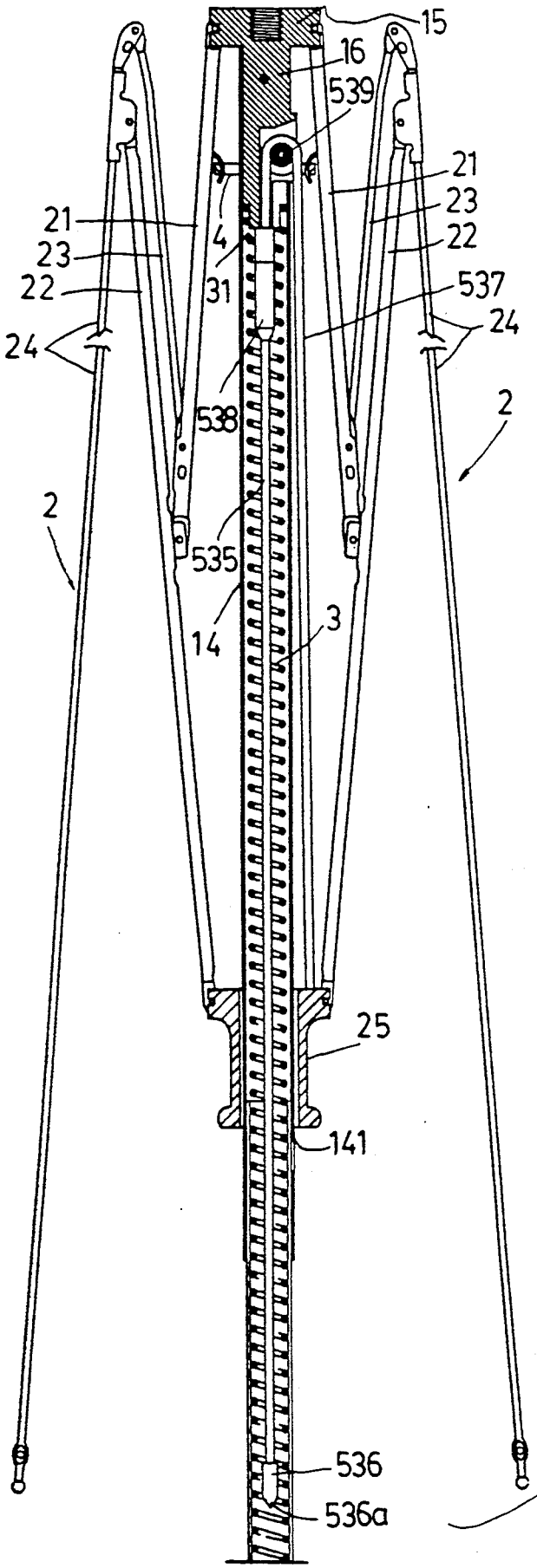
FIG. 16 shows a closed umbrella when closed from FIG. 15.
Figure 16:
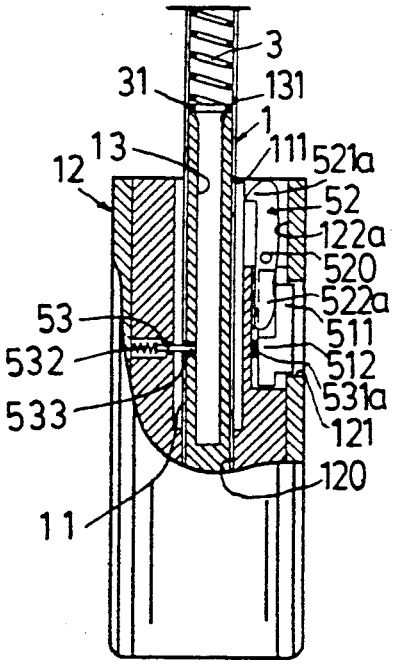
Figure 20:
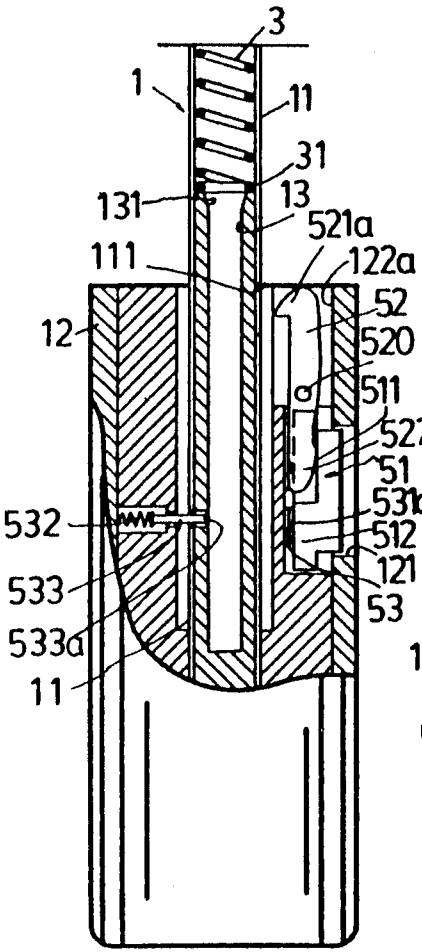
FIG. 20 shows a closed umbrella also shown in FIG. 16.

The button 51 is further depressed to actuate the closing controller 53 to close the umbrella as shown in FIGS. 16 and 20. Further compression of the grip to restore the spring 3, the umbrella will be kept at its folded state as shown in FIGS. 17 and 14.

The helical springs 531*a* of this invention may be modified to be other spring members. Other modification may be made without departing from the spirit and scope as claimed in this invention.

I claim:

1. An automatic umbrella comprising:

a central shaft means including a lower tubular shaft, a grip fixed on a lower portion of said lower tubular shaft, a sleeve inserted in said lower shaft, an upper tubular shaft telescopically mounted on said lower tubular shaft, and an upper notch formed on an upper portion of said upper shaft;

a rib assembly secured with an umbrella cloth thereon including at least a top rib pivotally secured to said upper notch and a stretcher rib pivotally secured to a runner slidably encompassed on said upper shaft;

an extending spring retained in said central shaft means between said sleeve and said upper notch;

a retraction restoring spring secured in said rib assembly normally urging said rib assembly downwardly inwardly for closing said umbrella; and a control means including a straightforward push button resiliently retained in a button hole formed in a side portion of said grip for operatively actuating an opening controller for opening the umbrella and operatively actuating a closing controller for closing the umbrella;

said opening controller including a pair of bifurcate arm members laterally slidably held in an upper portion of said grip operatively disposed around a lower portion of said upper shaft normally contacting an upper portion of said push button, a latch portion formed in a central portion of said opening controller between said two arm members operatively engaging a lower hole formed in a lower portion of said upper shaft for locking said upper shaft at a folded state, and an upper tensioning spring held in said grip normally urging said latch portion and said arm members outwardly adapted to be depressed by said push button; and said closing controller including a pair of bifurcate short stems laterally slidably held in a lower portion of said grip under said arm members operatively disposed around said lower shaft, a retarding plate formed in a central portion of said closing controller between said two stems, a pair of spring members each said spring member formed on each said stem, a lower tensioning spring normally urging said retarding plate and said spring members outwardly to contact a lower portion of said push button, and a drag rod slidably held in said shaft means secured between said runner and a locking head formed on a lower end portion of said drag rod normally locked by said retarding plate of said closing controller; whereby upon a first depression of said push button to press said arm members of said opening controller inwardly to disengage said upper shaft from said latch portion of said opening controller, said extending spring will extend said shaft means and said rib assembly for opening said umbrella; and upon a second depression of said push button to press said spring members of said closing controller inwardly to unlock said retarding plate from said locking head, said retraction restoring spring will retract said rib assembly and said shaft means for closing said umbrella.

2. An automatic umbrella according to claim 1, wherein said latch portion of said opening controller includes an outer portion tapered downwardly.

3. An automatic umbrella according to claim 1, wherein said retarding plate of said closing controller is formed with an arcuate surface on an outer portion of said retarding plate slidably engageable with said drag rod.

4. An automatic umbrella according to claim 1, wherein said two spring members are two helical springs respectively jacketed on said two short stems of said closing controller defining an aperture therebetween generally equal to an outside diameter of said lower shaft, and being operatively biased and separated by said upper shaft telescopically mounted on said lower shaft to define a second aperture larger than a width of said push button.

5. An automatic umbrella according to claim 1, wherein said upper shaft includes a recess portion formed in a lower portion of said upper shaft positioned above said retarding plate of said closing controller when folding said umbrella, and a lower flange formed on a lower portion of said upper shaft below said recess portion for operatively biasing and separating said two helical springs of said closing controller without being depressed by said button for preventing a false actuation of said closing controller.

6. An automatic umbrella comprising:

a central shaft means including a lower tubular shaft, a grip fixed on a lower portion of said lower tubular shaft, a sleeve inserted in said lower shaft, an upper tubular shaft telescopically mounted on said lower tubular shaft, and an upper notch formed on an upper portion of said upper shaft;

a rib assembly secured with an umbrella cloth thereon including at least a top rib pivotally secured to said upper notch and a stretcher rib pivotally secured to a runner slidably encompassed on said upper shaft;

an extending spring retained in said central shaft means between said sleeve and said upper notch;

a retraction restoring spring secured in said rib assembly normally urging said rib assembly downwardly inwardly for closing said umbrella; and a control means including a straighforward push button resiliently retained in a button hole formed in a side portion of said grip for operatively actuating an opening controller for opening the umbrella and operatively actuating a closing controller for closing the umbrella;

said opening controller generally formed as a biasing lever pivotally formed in an upper socket in said grip including a hook portion formed on an upper portion of said biasing lever engageable with a lower hole formed in a lower portion of said upper shaft, and a depression block formed on a lower portion of said biasing lever normally urged outwardly by an upper tensioning spring held in said grip to normally contact an upper portion of said push button adapted to be depressed by said push button for disengaging said upper shaft from said hook portion for opening said umbrella; and said closing controller including a pair of bifurcate short stems laterally slidably held in a lower portion of said grip under said arm members operatively disposed around said lower shaft, a retarding plate formed in a central portion of said closing controller between said two stems, a pair of helical springs each said helical spring jacketed on each said stem, a lower tensioning spring normally urging said retarding plate and said helical springs outwardly to contact a lower portion of said push button, and a drag rod slidably held in said shaft means secured between said runner and a locking head formed on a lower end portion of said drag rod normally locked by said retarding plate of said closing controller, said helical springs being operatively depressed to press said retarding plate inwardly to unlock said locking head for closing said umbrella as urged by said retraction restoring spring.

* * * * *